United States Patent [19]

Hamner, deceased et al.

[11] Patent Number: 4,919,786

[45] Date of Patent: Apr. 24, 1990

[54] PROCESS FOR THE HYDROISOMERIZATION OF WAX TO PRODUCE MIDDLE DISTILLATE PRODUCTS (OP-3403)

[75] Inventors: Glen P. Hamner, deceased, late of Baton Rouge, La., by Nita A. M. Hamner, executrix; Willard H. Sawyer, Baton Rouge, La.; Heather A. Boucher, Point Edward, Canada

[73] Assignee: Exxon Research and Engineering Company, Florham Park, N.J.

[21] Appl. No.: 283,681

[22] Filed: Dec. 13, 1988

Related U.S. Application Data

[63] Continuation-in-part of Ser. No. 134,960, Dec. 18, 1987, abandoned.

[51] Int. Cl.[5] ..... C10G 65/12; C10G 67/02; C10G 73/38

[52] U.S. Cl. ..... 208/27; 208/46; 208/39; 208/88; 208/112; 208/950; 585/736; 585/737; 585/749; 502/230; 502/231; 502/334

[58] Field of Search ..... 585/749, 737, 748, 736; 208/27, 59, 46, 112, 88, 950; 502/230, 231, 334

[56] References Cited

U.S. PATENT DOCUMENTS

| | | | |
|---|---|---|---|
| 2,668,866 | 2/1954 | Good et al. | 208/46 |
| 2,817,693 | 12/1957 | Koome et al. | 208/46 |
| 3,268,436 | 8/1966 | Arey et al. | 208/58 |
| 3,338,843 | 8/1967 | Goble et al. | 502/230 |
| 3,692,695 | 9/1972 | Suggit et al. | 502/228 |
| 3,692,697 | 9/1972 | Kravitz et al. | 502/228 |
| 3,709,817 | 1/1973 | Suggit et al. | 208/112 |
| 3,717,586 | 2/1973 | Suggit et al. | 208/108 |
| 4,139,494 | 2/1979 | Itoh et al. | 208/27 |
| 4,472,529 | 9/1984 | Johnson et al. | 502/228 |
| 4,684,756 | 8/1987 | Derr, Jr. et al. | 585/330 |
| 4,832,819 | 5/1989 | Hamner et al. | 208/27 |

*Primary Examiner*—Anthony McFarlane
*Attorney, Agent, or Firm*—Roy J. Ott

[57] ABSTRACT

A process for selectively producing middle distillate fuel products from paraffin waxes such as slack wax and Fischer-Tropsch wax by hydroisomerizing the wax to convert 60–95 weight percent per pass of the 700° F.⁻ fraction contained in said wax. The catalyst employed is a fluorided Group VIII metal-on-alumina catalyst where the fluoride within the catalyst is present predominately as aluminum fluoride hydroxide hydrate. The preferred Group VIII metal is platinum.

26 Claims, 5 Drawing Sheets

PROCESS FOR THE HYDROISOMERIZATION OF WAX TO PRODUCE MIDDLE DISTILLATE PRODUCTS (OP-3403)

CROSS REFERENCE TO PRIOR APPLICATION

This is a Continuation-in-Part application of prior application Ser. No. 134,960 filed December 18, 1987, now abandoned, which is the subject of a petition to revive an unintentionally abandoned application.

BACKGROUND OF THE INVENTION

1. Field of the Invention

This invention relates to a process for producing middle distillate products from a paraffin wax. More particularly, it relates to a process utilizing a Group VIII metal-on-alumina catalyst for hydroisomerizing a Fischer-Tropsch or hydrotreated petroleum slack wax to produce predominately middle distillate products normally boiling in the range of about 320° F. to 700° F.

2. Description of the Prior Art

In the Fischer-Tropsch process a synthesis gas ($CO+H_2$) made, e.g., from natural gas, is converted over a catalyst, e.g., a ruthenium, iron or cobalt catalyst, to form a wide range of products inclusive of gaseous and liquid hydrocarbons, and oxygenates, and a normally solid paraffin wax which does not contain the sulfur, nitrogen or metals impurities normally found in crude oil. It is generally known to catalytically convert the paraffin wax, or syncrude obtained from such process to lower boiling paraffinic hydrocarbons falling within the gasoline and middle distillate boiling ranges.

Paraffin waxes have been isomerized over various catalysts, e.g., Group VIB and VIII catalysts of the Periodic Table of the Elements (E. H. Sargent & Co., Copyright 1964 Dyna-Slide Co.) Certain of such catalysts can be characterized as halogenated supported metal catalysts, e.g., a hydrogen chloride or hydrogen fluoride treated platinum-on-alumina catalyst as disclosed, e.g., in U.S. Pat. No. 2,668,866 to G. M. Good et al. In the Good et al process a partially vaporized wax, such as one from a Fischer-Tropsch synthesis process, is mixed with hydrogen and contacted at 300° C. to 500° C. over a bed of supported platinum catalyst. Palladium or nickel may be substituted for platinum. The support may be a number of conventional carrier materials, such as alumina or bauxite. The carrier material may be treated with acid, such as HCl or HF, prior to incorporating the platinum. In preparing the catalyst, pellets of activated alumina may be soaked in a solution of chloroplatinic acid, dried and reduced in hydrogen at 475° C.

U.S. Pat. No. 2,817,693 discloses the catalyst and process of U.S. Pat. No. 2,668,866 with the recommendation that the catalyst be pretreated with hydrogen at a pressure substantially above that to be used in the process.

U.S. Pat. No. 3,268,439 relates to the conversion of waxy hydrocarbons to give products which are characterized by a higher isoparaffin content than the feedstock. Waxy hydrocarbons are converted at elevated temperature and in the presence of hydrogen by contacting the hydrocarbons with a catalyst comprising a platinum group metal, a halogenatable inorganic oxide support and at least one weight percent of fluorine, the catalyst having been prepared by contacting the support with a fluorine compound of the general formula:

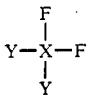

where X is carbon or sulphur and Y is fluorine or hydrogen.

U.S. Pat. No. 3,308,052 describes a hydroisomerization process for producing lube oil and jet fuel from waxy petroleum fractions. According to this patent, product quality is dependent upon the type of charge stock, the amount of liquid hydrocarbon in the waxy charge stock and the degree of conversion to products boiling below 650° F. The greater the amount of charge stock converted to material boiling below 650° F. per pass the higher the quality of jet fuel. The catalyst employed in the hydroisomerization zone is a platinum group metal catalyst comprising one or more platinum, palladium and nickel on a support, such as alumina, bentonite, barite, faujasite, etc., containing chlorine and/or fluorine.

In U.S. Pat. No. 3,365,390 a heavy oil feed boiling at least partly above 900° F. is hydrocracked and the oil effluent thereof is separated into fractions, including a distillate fuel and a higher boiling hydrocracked lube oil boiling range fraction. The hydrocracked lubricating oil boiling range fraction is dewaxed to obtain a hydrocracked wax fraction which is hydroisomerized in the presence of a reforming catalyst and the oil effluent thereof is separated into fractions, including a distillate fuel and an isomerized lube oil boiling range fraction.

In U.S. Pat. No. 3,486,993 the pour point of a heavy oil is lowered by first substantially eliminating organic nitrogen compounds present in the oil and then contacting the nitrogen-free oil with a reforming catalyst in a hydrocracking-hydroisomerization zone. Hydroisomerization is conducted at a temperature of 750° F.-900° F. over a naphtha reforming catalyst containing no more than two weight percent halide.

U.S. Pat. No. 3,487,005 discloses a process for the production of low pour point lubricating oils by hydrocracking a high pour point waxy oil feed boiling at least partly above 700° F. in at least two stages. The first stage comprises a hydrocracking-denitrofication stage, followed by a hydrocracking-isomerization stage employing a naphtha reforming catalyst containing a Group VI metal oxide or Group VIII metal on a porous refractory oxide, such as alumina. The hydrocracking isomerization catalyst may be promoted with as much as two weight percent fluorine.

U.S. Pat. No. 3,709,817 describes a process which comprises contacting a paraffin hydrocarbon containing at least six carbon atoms with hydrogen, a fluorided Group VIB or VIII metal alumina catalyst and water. These catalysts are classified by the patentee as a well-known class of hydrocracking catalysts.

U.S. Pat. No. 3,268,436 describes a process for the hydrocracking of paraffin waxes using a platinum metal cracking catalyst to produce jet fuel. The catalyst is preferably a silica-alumina zeolite.

SUMMARY OF THE INVENTION

A process for producing middle distillate fuel products from high boiling paraffin waxes, which process comprises (a) contacting the wax with hydrogen in a hydroisomerization zone with a fluorided Group VIII metal-on-alumina catalyst to convert about 50 to about 95 weight percent therein, i.e., per pass, of the 700° F.+ material in the wax to material boiling in the middle distillate fuel range (i.e., 320°-700° F.) and (b) separating the product from (a) into at least one fraction having a final boiling point below about 320° F. at atmospheric pressure, a middle distillate fraction boiling in the range of about 320° to 700° F. at atmospheric pressure and a residual fraction. The production of middle distillate fuels from paraffin waxes using platinum fluoride alumina catalysts is known in the art. It has now been found that the yield of middle distillate material from platinum fluoride catalysts in maximized if the conversion of the 700° F.+ fraction in the feed is maintained at certain levels and the catalyst possesses certain physical characteristics. The catalyst shall have: (i) a bulk fluoride concentration (i.e., based on the total weight of the catalyst composition) of from about 2 to about 10 weight percent, wherein the fluoride concentration is less than about 3.0 weight percent at the outer surface layer to a depth less than one one hundredth of an inch, provided the surface fluoride concentration is less than the bulk fluoride concentration; and (ii) a ratio of nitrogen to alumina (N/Al) less than about 0.005. In addition, it has been found that very selective catalysts have a high proportion of the fluoride in the form of aluminum fluoride hydroxide hydrate species. Thus, a further requirement of the catalyst is (iii) an aluminum fluoride hydroxide hydrate peak height, as determined by X-ray diffraction at 5.66 Å, greater than about 60 percent of that of a Reference Standard, as defined below.

In a further embodiment, a process for producing middle distillate fuel products from a Fischer-Tropsch wax containing oxygenate compounds, which process comprises:

(1) separating the Fischer-Tropsch wax into (a) a low-boiling fraction which contains most of the oxygenate compounds and (b) a high-boiling fraction which is substantially free of water and oxygenate compounds;

(2) reacting the high-boiling fraction from step (1) with hydrogen in a hydroisomerization zone in the presence of a fluorided Group VIII metal-on-alumina catalyst to convert from about 50 to about 95 percent therein of the 700° F.+ material present in the high boiling fraction thereby maximizing the production of middle distillate product boiling in the range about 320° F. to 700° F., said catalyst having (i) a bulk fluoride concentration ranging from about 2 to about 10 weight percent, wherein the fluoride concentration is less than about 3.0 weight percent at the outer surface layer to a depth less than one one hundredth of an inch, provided the surface fluoride concentration is less than the bulk fluoride concentration, (ii) an aluminum fluoride hydroxide hydrate level greater than about 60 where an aluminum fluoride hydrate level of 100 corresponds to the X-ray diffraction peak height at 5.66 Å for a Reference Standard and (iii) a N/Al ratio less than about 0.005;

(3) separating the product from step (2) into at least one fraction having a final boiling point below about 320° F. at atmospheric pressure, a middle distillate fraction boiling in the range of about 320° to 700° F. at atmospheric pressure and a residual fraction; and (4) recycling the residual fraction from step (3) to the hydroisomerization zone.

In another embodiment of the invention, at least a portion of the 700° F.+ bottoms from the hydroisomerization zone is either (a) further processed in a second hydroisomerization zone or (b) fractionated and/or dewaxed for the production of a lubricating oil fraction boiling in the range of about 650° F. to about 950° F.

BRIEF DESCRIPTION OF THE DRAWINGS

FIG. 1 further depicts an optional process scheme for making premium lubricating oil base stocks in addition to middle distillate products.

DESCRIPTION OF THE PREFERRED EMBODIMENTS

In accordance with the invention, a paraffin wax is converted to a product containing predominately middle distillates boiling in the range of 320° F. to 700° F. at atmospheric pressure. Products boiling in the range of about 320° F. to about 550° F. may be employed as jet fuels and products boiling in the range of about 550° F. to about 700° F. may be employed as diesel fuels.

The catalyst of the present invention maximizes the production of material boiling in the range 320°-700° F. by the hydroisomerization of paraffinic waxes. Existing hydroisomerization and hydrocracking catalysts convert paraffin waxes to lower boiling materials with excessive production of gases and low boiling hydrocarbons. This is accompanied by the consumption of a large volume of hydrogen gas, which is expensive. In addition, products boiling below about 320° F., i.e. in the gasoline range, exhibit low octane numbers, and as such, are very undesirable. An example of the production of a large amount of gas during the hydrocracking of microcrystalline wax is given in U.S. Pat. No. 3,268,436 to Arey et al.

The wax to be converted includes Fischer-Tropsch wax and hydrotreated slack wax recovered from the conventional dewaxing of petroleum feedstocks. Fischer-Tropsch wax is a particularly preferred feedstock for the process of the invention. This wax may be made as a by-product from the conversion of natural gas under known conditions to a synthesis gas ($CO+H_2$) which may then be converted by the Fischer-Tropsch process to form gaseous and liquid hydrocarbons and a normally solid paraffin wax known as Fischer-Tropsch wax. This wax does not contain the sulfur, nitrogen or metal impurities normally found in crude oil, but it is known to contain water and a number of oxygenate compounds such as alcohols, ketones, aldehydes, etc. These oxygenate compounds have an adverse effect on the performance of the hydroisomerization/hydrocracking catalyst of the invention and it is, therefore, advantageous to produce middle distillate products by the process scheme outlined in FIG. 1.

Figure 1:
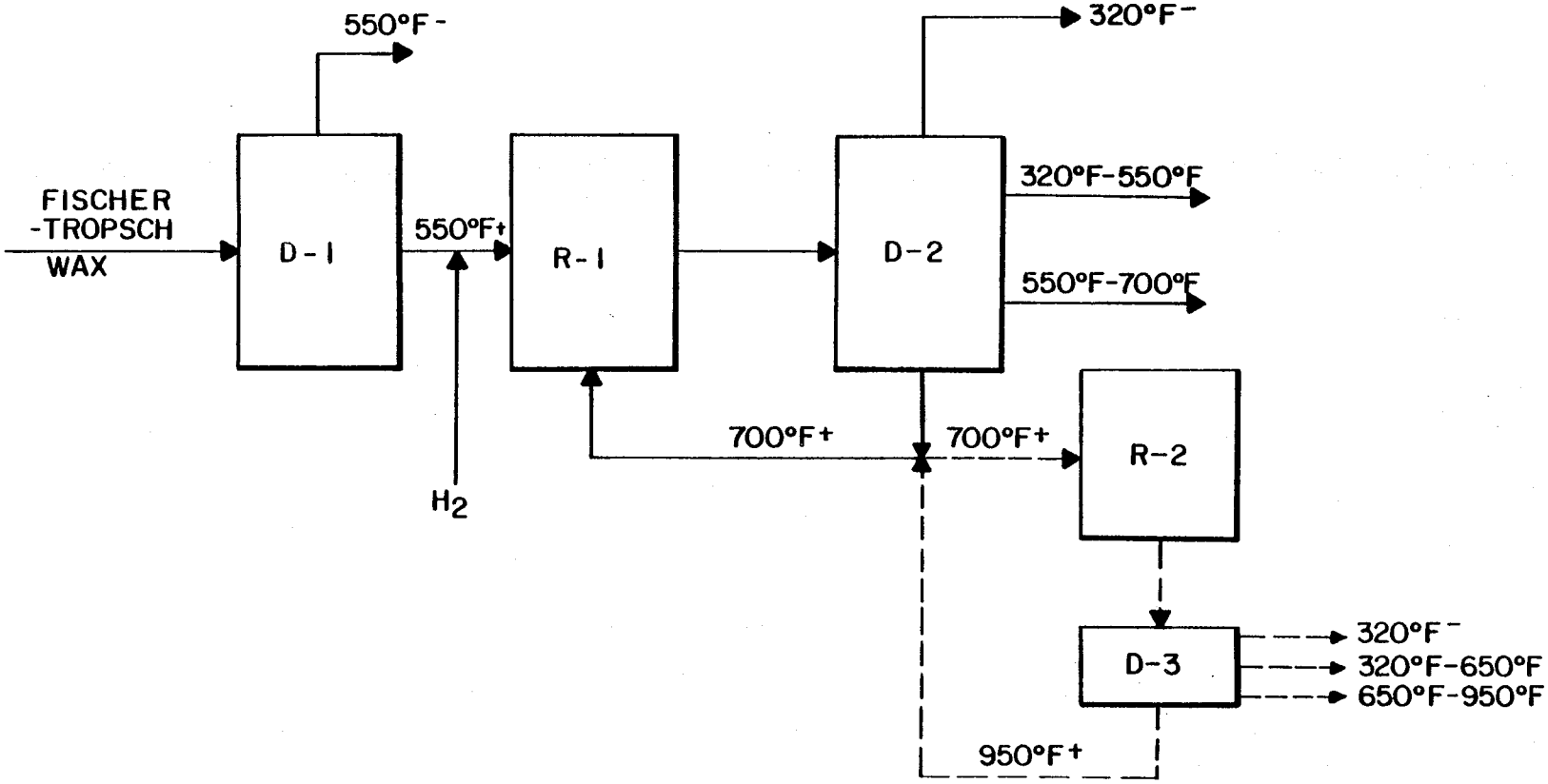
FIG. 1 schematically depicts a process of the invention for the production of a middle distillate product boiling substantially in the range of about 320° F. to 700° F. from a Fischer-Tropsch wax by reaction with hydrogen over a fixed bed of the catalyst of this invention in a hydroisomerization reactor.

Referring to FIG. 1, a virgin Fischer-Tropsch wax is first separated by distillation in distillation column D-1 into two fractions, a low boiling fraction containing water and olefinic-oxygenate-components, and a high-boiling fraction which is substantially devoid of water and olefinic-oxygenate components. Preferably, the high-boiling fraction will contain less than 0.5 weight percent (wt. %) oxygen, more preferably less than 0.3 wt % oxygen. This can be accomplished generally by establishing a cut point between about 450° F. and about 650° F., preferably between about 500° F. and about 600° F., suitably, e.g., at about 550° F. Thus, a 550° F.− fraction, or hydrocarbon fraction having a high end boiling temperature of 550° F. (i.e., 550° F.−) contains most of the oxygenates, and a higher boiling fraction, suitably a 500° F.+ fraction, is substantially devoid of oxygenates. The pour point of the low-boiling, or 550° F.− fraction is relatively low, while the melt point of the high-boiling, or 550° F.+ fraction, is quite high, i.e., >200° F.

A fluorided Group VIII metal-on-alumina catalyst of this invention is charged into a reactor R-1 and provided therein as a fixed bed, or beds. The hot liquid high-boiling, or 550° F.+ Fischer-Tropsch wax from which the 550° F.− fraction is first separated via distillation in fractionator D-1 is charged as a feed, with hydrogen, into reactor R-1 and reacted at hydroisomerizing conditions over said bed of catalyst. Hydrogen consumption and water formation are low because most of the olefins and oxygenates were removed from the original Fischer-Tropsch wax on separation of the low-boiling, or 550° F.− fraction therefrom. Suitably, such reaction is carried out at temperatures ranging between about 600° F. and about 750° F., preferably from about 650° F. to about 700° F., at a feed space velocity (liquid hourly space velocity, LHSV) of from about 0.2 to about 2 V/V/Hr. (volume of feed per volume of reactor per hour), preferably from about 0.5 to about 1 V/V/Hr. Pressure is maintained at from about 250 pounds per square inch gauge (psig) to about 1500 psig, preferably from about 500 psig to about 1000 psig, and hydrogen is fed into the reactor at a rate of about 500 SCF/B (standard cubic feet of hydrogen per barrel of feed) to about 15,000 SCF/B, preferably from about 4000 SCF/B to about 7000 SCF/B. The conditions in reactor R-1 are preferably selected to convert about 70 to 90 weight percent of the material boiling above about 700° F. which is present in the feed to reactor R-1. It has been found that 700° F.+ material conversion in the 60 to 80 percent range maximizes the production of middle distillate product.

The total effluent from the reactor R-1 is introduced into fractionator D-2 wherein it is separated into fractions having a boiling end point below about 320° F. (gas and naphtha product), a boiling point in the range of about 320° F. to 550° F. (a middle distillate suitable for jet fuels), a boiling point in the range of about 550° to 700° F. (a middle distillate suitable for diesel fuel) and an initial boiling point above about 700° F. The 700° F.+ fraction is recycled back to reactor R-1. The 550° F.− from distillation unit D-1 may be added to the 320° F.-550° F. fraction from fractionator D-2.

In a further embodiment of the invention, at least a portion of the 700° F.+ bottoms from fractionator D-2 is introduced with hydrogen into reactor R-2 wherein it is reacted at hydroisomerizing and mild hydrocracking conditions over a fluorided Group VIII metal-on-alumina catalyst of the invention. The reactor conditions employed in reactor R-2 are described hereinabove with respect to reactor R-1. The total effluent from reactor R-2 is introduced into fractionator D-3 wherein it is separated into one or more fractions boiling below about 700° F., a lubricating oil boiling in the range about 700° F. to about 950° F. and a bottoms fraction boiling above about 950° F. The 950° F.+ fraction is shown as being recycled to reactor R-1 or R-2. The lubricating oil fraction recovered from fractionator D-3 may be used as a high quality lube base stock without the need for any dewaxing.

It has been found that conversion in the range of about 50 to 95 weight percent of the 700° F.+ fraction in the feed to reactor R-1 will maximize the production of middle distillate product, notably jet and diesel fuels. In a preferred embodiment, the level of conversion of a Fischer-Tropsch wax feed will be in the range of about 70 to 90 weight percent of the 700° F.+ fraction in the feed to R-1 and the level of conversion of a slack wax feed will be in the range of about 85–90 weight percent of the 700° F.+ fraction in the feed to R-1.

Figure 2:
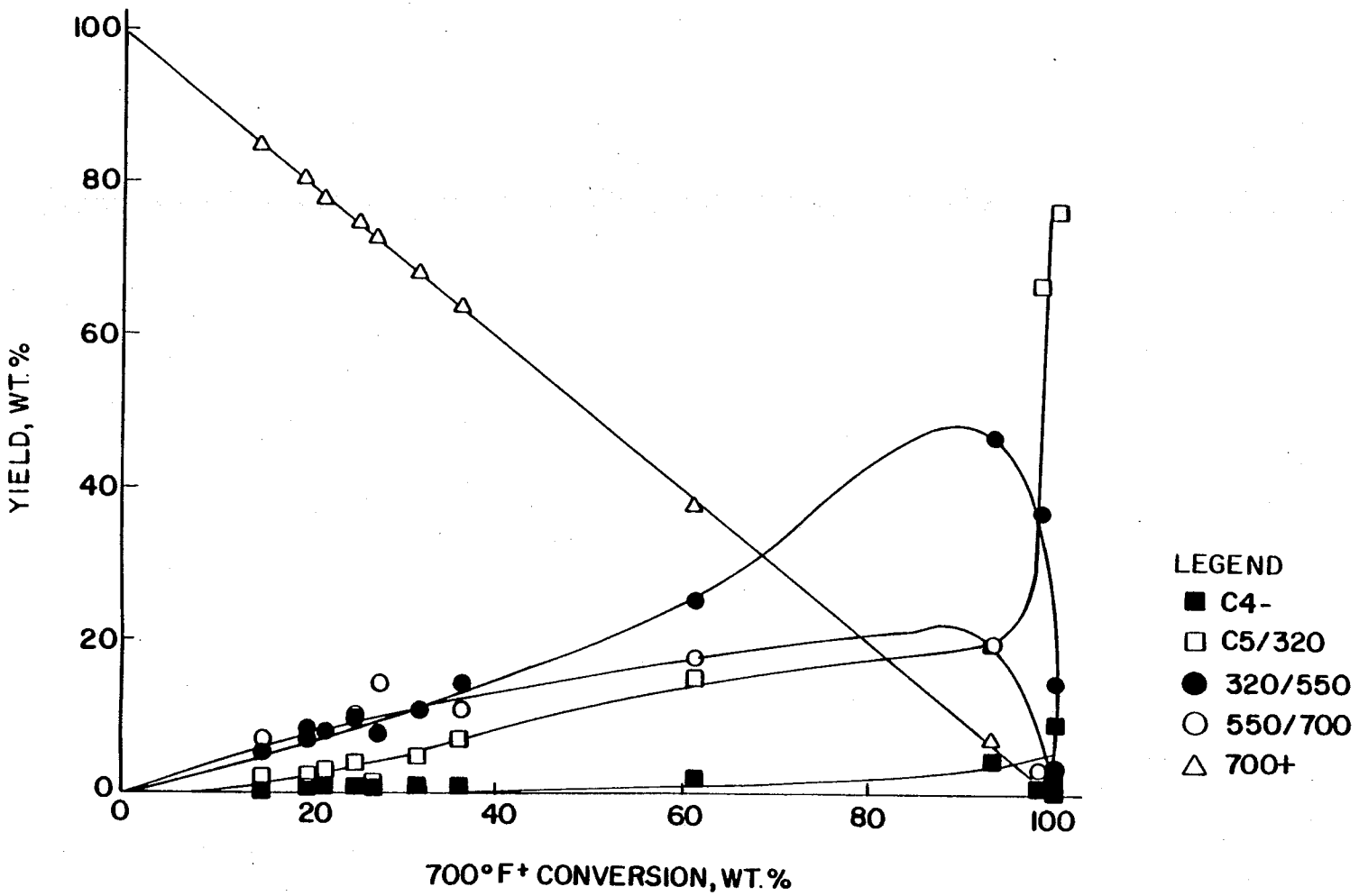
FIGS. 2, 3 and 4 show plots of yield of $C_4$−, $C_5$+-320° F., 320° F.-550° F., 550° F.-700° F. products vs. the degree of conversion of a hydrotreated petroleum slack wax having an initial boiling point above 700° F. for three particular catalysts used to hydroisomerize and hydrocrack the 700° F.+ wax feed.
Figure 3:
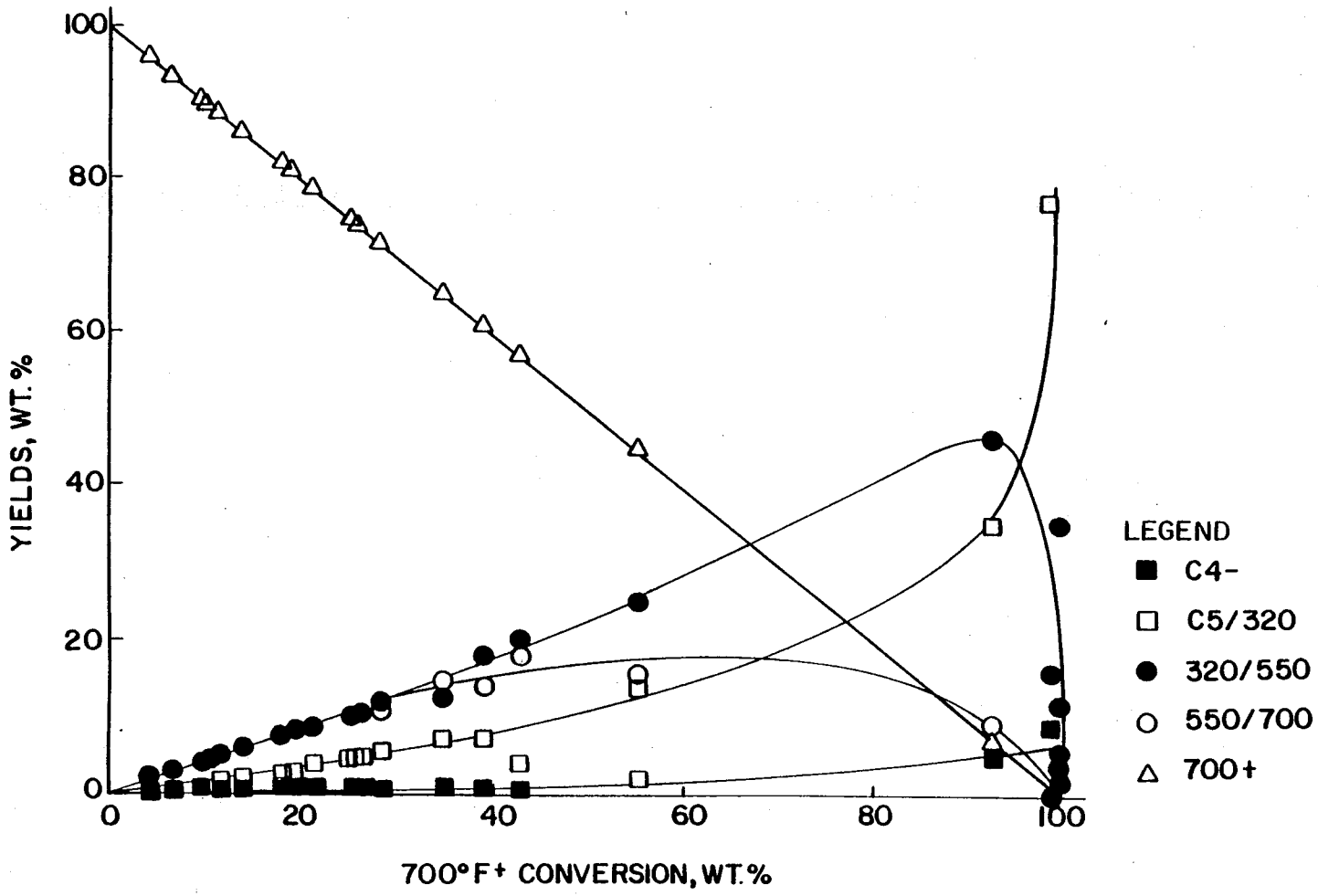
Figure 4:
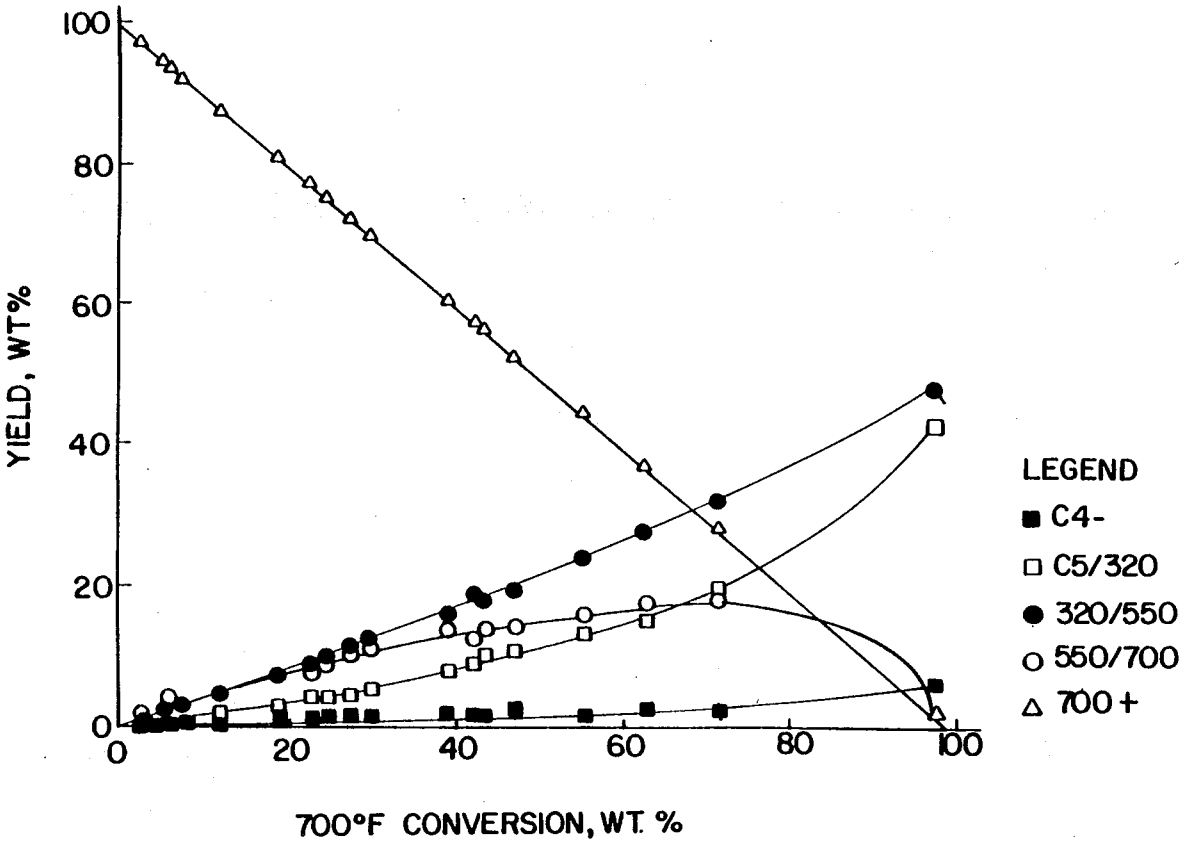
Figure 5:
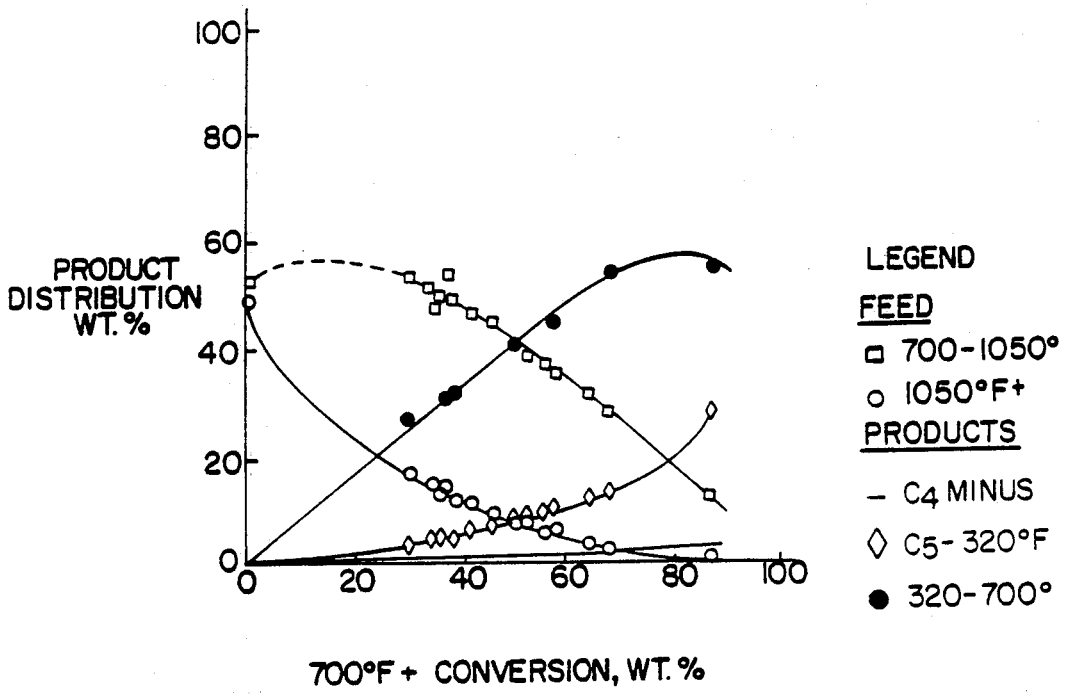
FIG. 5 is a similar plot for a 700° F.+ Fischer-Tropsch feed.

FIGS. 2, 3 and 4 are graphic illustrations showing the product distribution resulting from the conversion of a slack wax feed having an initial boiling point of about 700° F. In these figures, the percentage of slack wax feed material which remains unconverted in the hydroisomerization zone is plotted against the yield of products having various boiling points at atmospheric pressure. The products shown include $C_1$–$C_4$ gas fractions ($C_4$− gas) and those liquid products boiling in the ranges of $C_5$ to 320° F., 320° F. to 550° F., and 550° F. to 700° F. The results shown in these Figures were obtained by employing specific catalysts which are described hereinafter. It is observed that run conditions can be selected to maximize the production of middle distillate product in accordance with the invention. FIG. 5 shows similar data for a 700° F.+ Fischer-Tropsch wax.

The particulate catalysts employed in the process of this invention is a fluorided Group VIII metal-on-alumina catalyst composition where Group VIII refers to the Periodic Table of Elements (E. H. Sargent & Co., Copyright 1964 Dyna-Slide Co.). Platinum is the preferred Group VIII metal. It is to be understood that the alumina component of the catalyst may contain minor amounts of other materials, such as, for example, silica, and the alumina herein encompasses alumina-containing materials.

The fluorided Group VIII metal-on-alumina catalyst comprises about 0.1 to about 2 percent, preferably from about 0.3 to about 0.6 percent Group VIII metal and from about 2 percent to about 10 percent fluoride, preferably from about 5 percent to about 8 percent fluoride, based on the total weight of the catalyst composition (dry basis), said fluoride concentration being referred to herein as the bulk fluoride concentration.

The particulate catalyst of the invention will have a fluoride concentration less than about 3.0 weight percent, preferably less than about 1.0 weight percent and most preferably less than 0.5 weight percent at its outer surface layer, provided the surface fluoride concentration is less than the bulk fluoride concentration. The outer surface is measured to a depth less than one one hundredth of an inch. The surface fluoride was calculated from the total fluoride analysis and the electron microscope analysis. The remaining fluoride is distributed with the Group VIII metal at a depth below the outer shell into and within the particle interior.

The fluoride content of the catalyst can be determined in a number of ways.

One technique analyzes the fluorided catalyst using oxygen combustion methodology which is well established in the literature. Approximately 8–10 mgs of sample is mixed with 0.1 g benzoic acid and 1.2 gms of mineral oil in a stainless steel combustion capsule which is mounted in a 300 mL. Parr oxygen combustion bomb. The "sample" is purged of air and subsequently combusted under 30 Atms of pure oxygen. Combustion products are collected in 5 mL. of deionized water. Once the reaction has gone to completion (about 15 minutes), the absorbing solution is quantitatively transferred and made to fixed volume.

Fluoride concentration of the sample is determined by ion chromatography analysis of the combustion product solution. Calibration curves are prepared by combusting several concentrations of ethanolic KF standards (in the same manner as the sample) to obtain a 0–10 ppm calibration range. Fluoride concentration of the catalyst is calculated on an ignition-loss-free-basis by comparison of the sample solution response to that of the calibration curve. Ignition loss is determined on a separate sample heated to 800 degrees F. for at least 2 hours. Ion chromatographic analysis uses standard anion conditions.

Another procedure employs the use of fluoride distillation with a titrimetric finish. Fluorides are converted into fluorosilicic acid ($H_2SiF_6$) by reaction with quartz in phosphoric acid medium, and distilled as such using super heated steam. This is the Willard-Winter-Tananaev distillation. It should be noted that the use of super heated, dry (rather than wet) steam is crucial in obtaining accurate results. Using a wet steam generator yielded results 10–20% lower. The collected fluorosilicic acid is titrated with standardized sodium hydroxide solution. A correction has to be made for the phosphoric acid which is also transferred by the steam. Fluoride data are reported on an ignition-loss-free-basis after determination of ignition loss on sample heated to 400 degree C. for 1 hours.

The catalyst of the invention will be relatively free of nitrogen since nitrogen has been found to have a detrimental effect on the ability of the catalyst to convert wax. Accordingly, the catalyst of the invention will have a nitrogen to aluminum (N/Al) ratio less than about 0.005, preferably less than about 0.002, and most preferably less than about 0.0015.

The platinum contained on the alumina component of the catalyst will preferably have an average crystallite size of up to 50 Å and more preferably below about 30 Å.

The catalyst used in reactor R-1 to convert the heavy feed fraction will have high intensity peaks characteristic of aluminum fluoride hydroxide hydrate as well as the peaks normally associated with gamma alumina. X-ray diffraction data (X-ray Diffractometer, Scintag U.S.A.) show that the fluoride present in the preferred catalyst will be substantially in the form of aluminum fluoride hydroxide hydrate. This catalyst is described in detail in our co-pending application OP-3402 filed on the same date as the present application.

The relative X-ray diffraction peak height at 20–5.66 Å is taken as a measure of the aluminum fluoride hydroxide hydrate content of the catalyst. The 5.66 Å peak for the Reference Standard is taken as a value of 100. For example, fluorided platinum-on-alumina catalyst having a hydrate level of 60 would therefore have a 5.66 Å peak height equal to 60% of the 5.66 Å peak height of the Reference Standard, with a value of 80 corresponding to a catalyst having a 5.66 Å peak height equal to 80% of the 5.66 Å peak height of the Reference Standard etc. The catalyst used in reactor R-1 to convert the heavy feed fraction will have a hydrate level greater than about 60, preferably at least about 80, and most preferably at least about 100.

The Reference Standard contains 0.6 wt % Pt and 7.2 wt % F on $\gamma$ alumina having a surface area of about 150 $m^2/g$. The Reference Standard is prepared by treatment of a standard reforming grade platinum on alpha alumina material containing 0.6 wt % Pt on 150 $m^2/g$ surface area $\gamma$ alumina by single contact with an aqueous solution of hydrogen fluoride (e.g., 10–15 wt % HF solution such as 11.6 wt % HF solution) with drying at 150° C. for 16 hours. Catalyst A hereinafter defined is a Reference Standard catalyst.

The catalyst of the invention may be prepared in the following manner. The Group VIII metal, preferably platinum, can be incorporated with the alumina in any suitable manner, such as coprecipitation or co-gellation with the alumina support, or by ion exchange with the alumina support. In the case of a fluorided platinum-on-alumina catalyst, a preferred method for adding the platinum group metal to the alumina support involves the use of an aqueous solution of a water soluble compound, or salt of platinum to impregnate the alumina support. For example, platinum may be added to the support by co-mingling the uncalcined alumina with an aqueous solution of chloroplatinic acid, ammonium chloroplatinate, platinum chloride, or the like, to distribute the platinum substantially uniformly throughout the particle. Following the impregnation, the impregnated support can then be dried and subjected to a high temperature calcination, generally at a temperature in the range from about 700° F. to about 1500° F., preferably from about 850° F. to about 1300° F., generally by heating for a period of time ranging from about 1 hour to about 20 hours, preferably from about 1 hour to about 5 hours. The platinum component added to the alumina support, is calcined at high temperature to fix the platinum thereupon prior to adsorption of a fluoride, suitably hydrogen fluoride or hydrogen fluoride and ammonium fluoride mixtures, into the platinum-alumina composite. Alternatively the solution of a water soluble compound, or salt of platinum can be used to impregnate a precalcined alumina support, and the platinum-alumina composite again calcined at high temperature after incorporation of the platinum.

The Group VIII metal component is substantially uniformly distributed throughout a precalcined alumina support by impregnation. The Group VIII metal-alumina composite is then calcined at high temperature, and the fluoride, preferably hydrogen fluoride, is distributed onto the precalcined Group VIII metal-alumina composite in a manner that most of the fluoride will be substantially composited at a level below the outer surface of the particles.

The catalyst having the fluoride substantially in the form of aluminum fluoride hydroxide hydrate is preferably prepared in the following manner. The platinum is distributed, generally substantially uniformly throughout a particulate alumina support and the platinum-alumina composite is calcined. Distribution of the fluoride on the catalyst, preferably hydrogen fluoride, is achieved by a single contact of the precalcined platinum-alumina composite with a solution which contains the fluoride in sufficiently high concentration. Preferably an aqueous solution containing the fluoride in high concentration is employed, a solution generally containing from about 10 percent to about 20 percent, preferably from about 10 percent to about 15 percent hydrogen fluoride. Solutions containing hydrogen fluoride in these concentrations will be adsorbed to incorporate most of the hydrogen fluoride, at an inner layer below the outer surface of the platinum-alumina particles.

The platinum-alumina composite, after adsorption thereupon of the fluoride component is heated during preparation to a temperature ranging up to but not exceeding about 650° F., preferably about 500° F., and more preferably 300° F. A characteristic of the inner platinum-fluoride containing layer is that it contains a high concentration of aluminum fluoride hydroxide hydrate. It can be shown by X-ray diffraction data that a platinum-alumina catalyst formed in such manner displays high intensity peaks characteristic of both aluminum fluoride hydroxide hydrate and gamma alumina. An X-ray diffraction pattern can distinguish the catalyst of this invention from fluorided platinum alumina catalysts of the prior art.

The invention, and its principle of operation, will be more fully understood by reference to the following.

EXAMPLE 1

A series of runs was made with different fluorided platinum-on-alumina catalysts in the form of 1/16 inch extrudates to determine the effect of the catalyst and feed conversion levels on the selective conversion of a petroleum slack wax to middle distillate fuel products. The slack wax had an initial boiling point of 700° F. at atmospheric pressure and was obtained by the conventional solvent dewaxing of a 600 Neutral waxy petroleum oil with a solvent mixture of 20 parts methyl ethyl ketone and 80 parts methyl isobutyl ketone. The resultant slack wax was conventionally hydrotreated with a nickel/molybdenum on alumina catalyst to reduce the sulfur and nitrogen content of the wax to less than 5 parts per million. The resultant slack wax was distilled to recover a fraction having an initial boiling point of 700° F.

In these runs, the slack wax feed was separately contacted with hydrogen over three different catalysts at constant conditions of feed rate, pressure and hydrogen addition while the temperature was adjusted to vary the conversion level of the 700° F. feed. The products recovered at various levels of 700° F.+ feed conversion were fractionated by distillation to determine the amount of naphtha, middle distillate and 700° F.+ material in the products. The light ends were measured by mass spectrometer analyses of the off gas. In all runs, the LHSV feed rate was 0.5 V/V/Hr, the reactor pressure was 1000 psig and the hydrogen addition rate was 5000 SCF/B. The data obtained are plotted in FIG. 2 wherein Catalyst A was used to convert the wax feed, in FIG. 3 wherein Catalyst B was used to convert the wax feed and in FIG. 4 wherein Catalyst C was used to convert the wax feed. These Catalysts are described as follows.

Catalyst A was prepared by impregnation of a precalcined commercial reforming catalyst available under the tradename Ketjen CK-306, in the form of 1/16" diameter extrudates, by contact with an aqueous solution of hydrogen fluoride (11.6 wt. % HF solution). The catalyst was covered with the HF solution for a period of 6 hours, and occasionally stirred. The HF solution was then decanted from the catalyst, and the catalyst then washed with deionized water. The catalyst was then dried overnight and throughout the day in flowing air, and then dried in an oven overnight at 300° F. The catalyst after drying was reduced by contact with hydrogen at 650° F. Prior to reduction in hydrogen, the catalyst had a relative peak height for aluminum fluoride hydroxide hydrate of 100 (Reference Standard). After reduction and processing at temperature up to 650° F., the relative peak height was 66. Catalyst A is a catalyst of the invention. The catalyst contained 0.0012 N/Al, 7.2 wt % total fluoride and 0.4 wt % fluoride at the edge.

Catalyst B was prepared in a manner identical to Catalyst A except that the catalyst was calcined at a temperature of 750° F. rather than 300° F. The catalyst was also reduced at 650° F. and processed at temperatures up to 650° F. The catalyst prior to reduction had a peak height of 60% which remained essentially unchanged after reduction and processing. Catalyst B is not a catalyst of the invention.

Catalyst C was prepared in a similar manner to Catalyst A except that the hydrogen fluoride solution was replaced by an aqueous solution of ammonium fluoride and hydrogen fluoride and calcined at 750° F. Prior to reduction and processing at temperatures up to 650° F., the relative peak height for the hydrate was 29 and decreased to 18% when discharged. Catalyst C is not a catalyst of the invention.

Referring to FIG. 2, it is seen that Catalyst A is selective for the production of middle distillate product (320° F.–550° F. and 550° F.–700° F.) at feed conversion levels in the range of 60 to 95 weight percent. Feed conversion levels in the range of 85–90 weight percent were particularly effective with the product comprising about 50 weight percent of a fraction boiling in the range of 320° F. to 550° F. and about 23 weight percent of a fraction boiling in the range of 550° F. to 700° F.

Referring to FIG. 3, it is seen that Catalyst B is not effective as Catalyst A for the production of middle distillate product. The amount of 320° F.–500° F. product recovered is somewhat similar, but the amount of 550° F.–700° F. product is significantly less.

Similarly, FIG. 4 shows that Catalyst C is not as effective as Catalyst A for the production of 550° F.–700° F. product.

EXAMPLE 2

A Fischer-Tropsch wax having the properties shown below in Table 1 was distilled to recover the 700° F.+ fraction which was subjected to two-staged hydroisomerization at various conversion levels over a catalyst as prepared and described in connection with Catalyst A of Example 1. In these runs, the feed rate, pressure and hydrogen addition in the first reactor were maintained constant while the temperature was adjusted to vary the degree of conversion for the Fischer-Tropsch wax fraction boiling above 700° F. The products recovered were measured as described in Example 1. The conditions employed in the first hydroisomerization zone were LHSV feed rate of 0.5 V/V/Hr., reactor pressure of 1000 psig and hydrogen addition rate of 4,000 SCF/B. The temperature ranged between 670°–690° F. The conversion levels of the 700° F.–1050° F. and 1050° F.+ fractions of the Fischer-Tropsch wax and the products recovered at various levels of feed conversion are shown in FIG. 5. It is seen that a maximum middle distillate yield of about 50 weight percent is obtained at a conversion level in the range of 70–90 percent.

TABLE 1

| Properties of Fischer-Tropsch Wax | | |
|---|---|---|
| Boiling Range, °F. | Wt. % | Gravity, °API |
| IPB-320 | 1.8 | 67.2 |
| 320-500 | 10.4 | 57.0 |
| 500-650 | 13.9 | 49.6 |
| 650-700 | 5.0 | 46.7 |
| 700-1050 | 35.8 | 42.6 |
| 1050+ | 33.1 | 33.3 |

The unconverted 700° F.+ wax recovered from the hydroisomerization zone was contacted with hydrogen in a second reactor over the catalyst described for use in the first reactor. Conditions in the second reactor were maintained within the ranges employed in the first reactor to convert about 70 weight percent of the unconverted wax introduced into the second reactor. The products recovered in D-3 from the second reactor included about 57 weight percent based on 700° F.+ feed to R-2 of a premium JP-7 jet fuel boiling in the range of 340°-600° F. and 12.7 weight percent based on 700° F+ feed to Reactor 1 of a premium lube boiling in the range 650°-1000° F. and having the properties shown in Tables 2 and 3, respectively.

TABLE 2

| Properties of Jet Fuel Recovered | | | |
|---|---|---|---|
| | Specification | | |
| Property | Min. | Max. | Jet Fuel |
| °API | 44 | 50 | 52 |
| Freeze Point °F. | | −46 | −53 |
| Lumin. No. | 75 | | 130 |
| Flash Point °F. | 140 | | 168 |
| Aromatics, wt. % | | 5 | 0 |

TABLE 3

| Properties of Lube Recovered | |
|---|---|
| Property | Lube |
| °API | 40.7 |
| Pour Point, °F.[1] | 0 |
| Viscosity, CS | |
| 100° F. | 24.7 |
| 210° F. | 5.0 |
| VI | 144 |

[1]No dewaxing required to meet pour point.

EXAMPLE 3

This Example demonstrates the inability of a platinum on zeolite catalyst to preferentially produce the middle distillate products produced by the catalyst of the present invention.

In this Example a platinum on zeolite beta catalyst (pore diameter of about 7 Angstroms) having the following properties was used to hydroisomerize a high boiling (initial boiling point greater than 700° F.) Fischer-Tropsch wax at the three conversion levels described below.

| Catalyst Description |
|---|
| Pt on zeolite beta |
| Pt content = 1.3 wt. % |
| Surface area = 283 $m^2/g$ by mercury porosimetry |
| Pore volume = 1.43 cc/g by mercury porosimetry |
| Silica/alumina ratio >53 |

The feed to the process was a high boiling (initial boiling point >700° F.), high melting (200° F.) Fischer-Tropsch wax. It was hydroisomerized at three conversion levels as described below.

| | CONVERSION LEVEL | | |
|---|---|---|---|
| PROCESS CONDITIONS | LOW | MEDIUM | HIGH |
| Temperature, °F. | 561 | 604 | 614 |
| v/v/h | 1.0 | 1.0 | 0.8 |
| Pressure, psi | 500 | 500 | 500 |
| Treat gas rate, $SCFH_2/B$ | 3668 | 3700 | 3900 |
| Yields on feed, wt. % | | | |
| $C_3-$ | 0.35 | 0.52 | 0.71 |
| $C_4$ | 1.87 | 2.55 | 3.85 |
| $C_5$/320° F. | 1.4 | 10.3 | 27.1 |
| 320/700° F. | 11.4 | 24.4 | 35.1 |
| 700° F.+ | 84.7 | 62.4 | 34.0 |

On comparing this data with FIG. 2 in this application, it is seen that at 66 wt % 700° F.+ conversion (high conversion case above) the platinum fluoride alumina catalyst gives a much higher yield of middle distillate. From FIG. 2, the mid distillate yield (320°/700° F.) is about 53.5 wt % compared to 35.1 wt % in the above example. This demonstrates that the platinum fluoride alumina catalyst of this invention is much more efficient at converting paraffinic wax to middle distillate material.

Having described the invention, what is claimed is:

1. A process for producing middle distillate fuel products from a paraffin wax, which process comprises (a) contacting the wax with hydrogen in a hydroisomerization zone in the presence of a fluorided Group VIII metal-on-alumina catalyst to convert from about 50 to about 95 weight percent therein of the 700° F.+ material present in the wax thereby maximizing the production of middle distillate fuel product; said catalyst having (i) a bulk fluoride concentration ranging from about 2 to about 10 weight percent, wherein the fluoride concentration is less than about 3.0 weight percent at the outer surface layer to a depth less than one one hundredth of an inch, provided the surface fluoride concentration is less than the bulk fluoride concentration; (ii) an aluminum fluoride hydroxide hydrate level greater than about 60 where an aluminum fluoride hydrate level of 100 corresponds to the X-ray diffraction peak height at 5.66 Å for a Reference Standard; and (iii) a N/Al ratio less than about 0.005 and (b) recovering a middle distillate product and a bottoms product having an initial boiling point above 700° F.

2. The process of claim 1 wherein said Group VIII metal is platinum.

3. The process of claim 1 wherein said catalyst contains about 0.1 to about 2 weight percent platinum.

4. The process of claim 3 wherein the catalyst has an aluminum fluoride hydroxide hydrate level of at least 80.

5. The process of claim 4 wherein at least a portion of the 700° F.+ bottoms product is recycled to the hydroisomerization zone.

6. The process of claim 5 wherein from about 85 wt % to about 90 wt % of the 700° F.+ material present in the feed to the hydroisomerization zone is converted therein.

7. The process of claim 6 wherein the catalyst has an aluminum fluoride hydrate level of at least about 100 and a fluoride concentration on the outer surface of less than about 1.0 weight percent.

8. The process of claim 7 wherein the catalyst contains a fluoride concentration in the range of about 5 to 8 weight percent, N/Al ratio less than about 0.002 and a fluoride concentration on the outer surface less than about 0.5 weight percent.

9. The process of claim 8 wherein said wax is a petroleum slack wax and said wax is hydrotreated to remove nitrogen and sulfur compounds prior to its introduction to the hydroisomerization zone.

10. The process of claim 3 wherein at least a portion of the 700° F.+ product is fractionated and dewaxed to produce a lubricating oil boiling in the range of about 650° F. to about 950° F.

11. The process of claim 4 wherein at least a portion of the 700° F.+ bottoms product is sent to a second hydroisomerization zone containing the catalyst described for use in the first hydroisomerization for contact with hydrogen and wherein the effluent from the second isomerization zone is fractionated into a light ends fraction boiling below about 700° F., a lubricating oil fraction boiling in the range of about 700° F. to 950° F. and a bottoms fraction having an initial boiling point above about 950° F.

12. The process of claim 11 wherein the 950° F.+ bottoms fraction is recycled to the first hydroisomerization zone.

13. A process for producing middle distillate fuel products from a Fischer-Tropsch wax containing oxygenate compounds, which process comprises:

(1) separating the Fischer-Tropsch wax into (a) a low-boiling fraction which contains most of the oxygenate compounds and (b) a high-boiling fraction which is substantially free of water and oxygenate compounds;

(2) reacting the high-boiling fraction from step (1) with hydrogen in a hydroisomerization zone in the presence of a fluorided Group VIII metal-on-alumina catalyst to convert from about 50 to about 95 percent of the 700° F.+ material present in the high-boiling fraction thereby maximizing the production of middle distillate product boiling in the range about 320° F. to 700° F., said catalyst having (a) a bulk fluoride concentration ranging from about 2 to about 10 weight percent, wherein the fluoride concentration is less than about 3.0 weight percent at the outer surface layer to a depth less than one one hundredth of an inch, provided the surface fluoride concentration is less than the bulk fluoride concentration, (b) an aluminum fluoride hydroxide hydrate level greater than about 60 where an aluminum fluoride hydroxide hydrate level of 100 corresponds to the X-ray diffraction peak height at 5.66 Å for a Reference Standard and (c) a N/Al ratio less than about 0.005; and (3) separating the product from step (2) into at least one fraction having a final boiling point below about 320° F. at atmospheric pressure, a middle distillate fraction boiling in the range of about 320°–700° F. at atmospheric pressure and a residual fraction having an initial boiling point above 700° F. at atmospheric pressure.

14. The process of claim 13 wherein said Group VIII metal is platinum.

15. The process of claim 14 wherein the catalyst employed in step (2) has an aluminum fluoride hydrate level of at least 80.

16. The process of claim 15 wherein said catalyst contains about 0.1 to 2 weight percent platinum and about 5 to 8 percent fluoride.

17. The process of claim 16 wherein the catalyst has a N/Al ratio less than about 0.002 and a fluoride concentration on the outer surface less than about 1.0 weight percent.

18. The process of claim 17 wherein the Fischer-Tropsch wax is separated in step (1) to produce a high-boiling fraction having an initial boiling point between about 450° F. and about 650° F. at atmospheric pressure.

19. The process of claim 18 wherein the unconverted 700° F.+ fraction in the product is recovered and recycled to the hydroisomerization zone.

20. The process of claim 19 wherein the catalyst employed in step (2) has an aluminum fluoride hydrate level of at least about 100 and a fluoride concentration on the outer surface of less than about 0.5 weight percent.

21. The process of claim 20 wherein from about 70 wt % to about 90 wt % of the 700° F.+ material present in the feed to the hydroisomerization zone is converted therein.

22. The process of claim 21 wherein the Fischer-Tropsch wax is separated in step (1) to produce a high-boiling fraction having an initial boiling point between about 500° F. and about 650° F. at atmospheric pressure.

23. The process of claim 22 wherein the low-boiling fraction from step (1) is combined with the 320° F.–700° F. fraction from step (3).

24. The process of claim 23 wherein wherein at least a portion of the residual fraction from step (3) is sent to a second hydroisomerization zone containing the catalyst described for use in the first hydroisomerization for contact with hydrogen and wherein the effluent from the second isomerization zone is fractionated into a light ends fraction boiling below about 700° F., a lubricating oil fraction boiling in the range of about 650° F. to 950° F. and a bottoms fraction having an initial boiling point above about 950° F.

25. The process of claim 24 wherein the 950° F.+ bottoms fraction is recycled to the first hydroisomerization zone.

26. The process of claim 25 comprising recovering a low pour point lubricating oil fraction in the absence of any dewaxing process step.

* * * * *